United States Patent [19]

Zampini, Jr.

[11] Patent Number: 4,651,473

[45] Date of Patent: Mar. 24, 1987

[54] BELT FINISHER

[76] Inventor: Louis Zampini, Jr., 37 Conifer Dr., North Providence, R.I. 02904

[21] Appl. No.: 792,510

[22] Filed: Oct. 29, 1985

[51] Int. Cl.[4] ..... B24B 21/00

[52] U.S. Cl. ..... 51/135 R; 51/148

[58] Field of Search ..... 51/135 R, 147, 148

[56] References Cited

U.S. PATENT DOCUMENTS

| | | | |
|---|---|---|---|
| 1,108,176 | 8/1914 | Hormel | 51/148 |
| 1,365,583 | 1/1921 | Brown | 51/147 |
| 1,391,185 | 9/1921 | Grupe | 51/148 |
| 2,273,696 | 2/1942 | Ducker | 51/135 |
| 2,452,206 | 10/1948 | Newton | 51/135 R |
| 2,815,613 | 12/1957 | Van Sittert | 51/135 R |
| 3,483,661 | 12/1969 | Schnizler | 51/148 |

*Primary Examiner*—Harold D. Whitehead
*Attorney, Agent, or Firm*—Robert J. Doherty

[57] ABSTRACT

A belt finisher of the type where an operating belt moves between a drive and driven wheel. The entire operable system of the device is supported on a fixed frame which in turn is mounted for partial rotation with respect to an overall support in two different planes so as to respectively vertically and laterally position the driven wheel with respect to objects to be finished, e.g., sanded or polished, at a work station. In addition, the drive system for the driving wheel is entirely carried by a pivotal plate which is in turn attached to the frame at the rear thereof. The drive system including means for continually tensioning the belt and for releasing such tension by partially rotating such pivotal plate.

6 Claims, 7 Drawing Figures

BELT FINISHER

BACKGROUND AND OBJECTS OF THE INVENTION

This invention relates to a belt finisher and particularly that type having a driven and drive wheel longitudinally spaced from each other with a part contact belt trained thereover. Devices of this type are used to grind, polish, burnish, or conduct other finish operations on objects disposed at a work station. In performing such operations, various machine attributes are desirable including the ability to vary the vertical positioning of the forwardly disposed work or contact wheel, the ability to use various length finishing belts, the ability to rotate the plane of the contact wheel between a position where the belt moves at right angles or normally across the work object to a position where the belt moves laterally or parallel therewith, the ability to move the contact wheel forwardly and rearwardly with respect to the work, the ability to easily and repeatedly change belts without modifying the positioning of the device, and the ability to rotate the finishing belt at various selected speeds. All of the above attributes of such a device are desirable and are known either singly or in multiple combinations with prior art devices. Generally such devices, however, require either the repositioning of the machine itself or adaptive parts to accomplish one or more of the above-indicated objectives, and no device of which the applicant is aware includes all such attributes in one device.

It is, accordingly, the primary object of the present invention to provide a novel belt finisher which accomplishes all the above elicited objects and does so in a straightforward manner such that a machine embodying the features can be made for a reasonable price and operated in a safe, uncomplicated manner. These and other objectives of the present invention are accomplished by a belt finisher having an endless belt trained over both a drive and driven wheel, a fixed position support having an outwardly extending shaft, a longitudinally oriented tubular frame, means for releasably adjustably mounting said frame to said support via said shaft, said mounting means including a T-shaped right-angled clamp, said clamp having a base segment in receipt of and releasably clamping said shaft and an open outer segment in receipt of and releasably clamping said tubular frame, means for mounting said driven wheel at the forward end of said frame and means for mounting drive means including said driving wheel at the rearward end of said frame, both said driven wheel and said drive wheel including the drive means therefor entirely supported and carried by said tubular frame, said frame both tiltable with respect to said support to move said driven wheel up and down with respect to a work station by partially rotating said clamp base segment with respect to said shaft and at least partially rotatable with respect to said support to move said driven wheel between vertical and horizontal dispositions with respect to said work station by partially rotating said tubular support with respect to said clamp outer segment.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
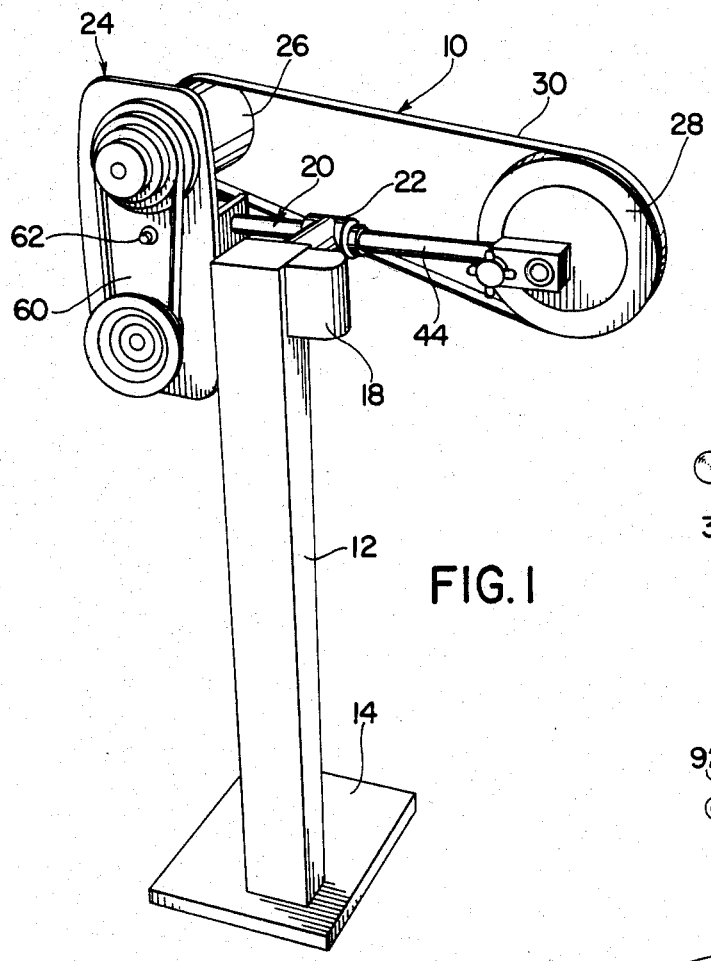
FIG. 1 is front perspective view showing the device of the present invention with various covers removed for clarity.

Referring to the drawings, the device 10 of the present invention includes a fixed support including an upright post 12 in turn supported by a base 14. At the upper end of the post 12, a stub shaft 16 outwardly extends therefrom. Such shaft 16 is fixed in position relative to the post 12 as by welding and the like. An electrical supply 18 is also positioned on the post 12.

Figure 2A:
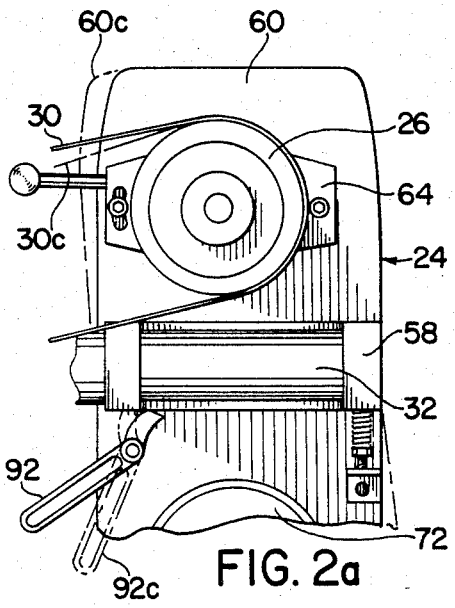
FIG. 2*a* is a partial rear elevational view showing the manner in which the drive means is tilted to release operating tension from the contact belt.
Figure 2:
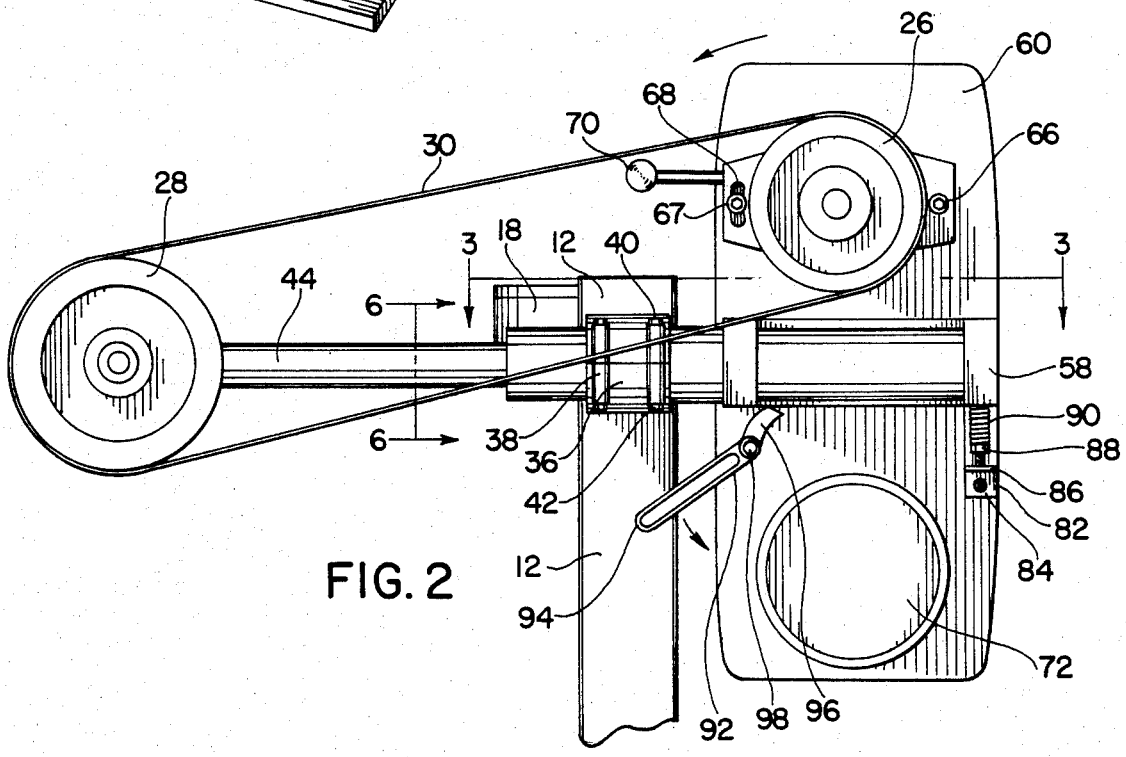
FIG. 2 is a rear elevational view thereof.
Figure 3:
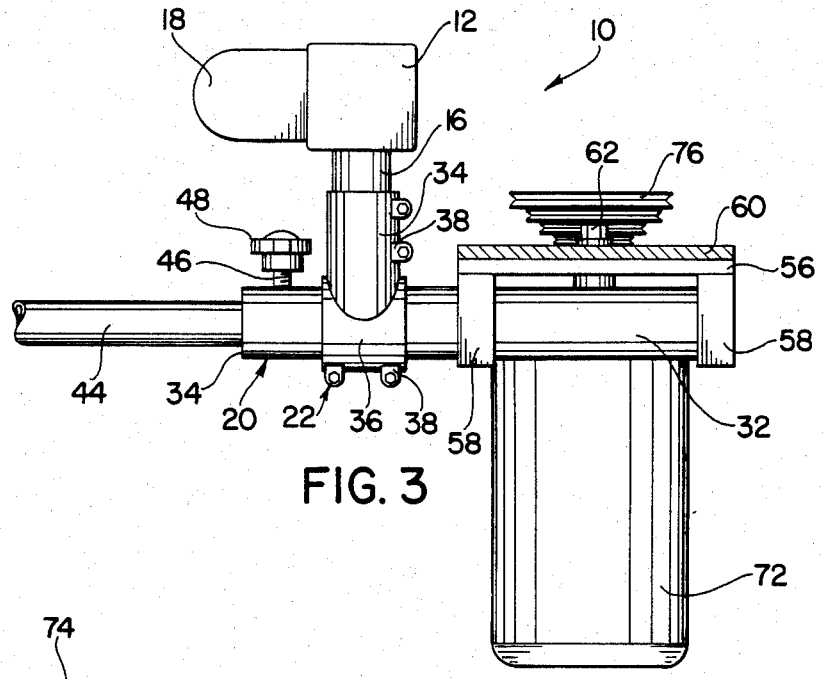
FIG. 3 is a sectional view taken along the line 3—3 of FIG. 2.
Figure 4:
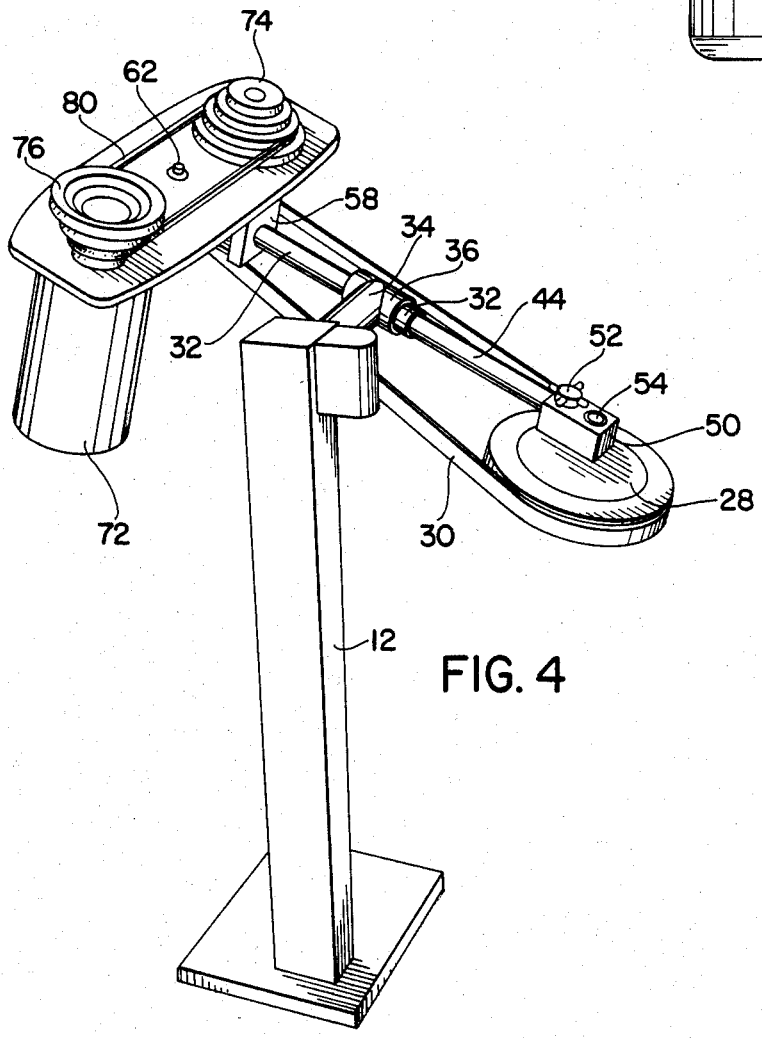
FIG. 4 is a front perspective view similar to FIG. 1 but showing the contact wheel displaced approximately 90 degrees to a position parallel to objects on a work station (not shown)
Figure 5:
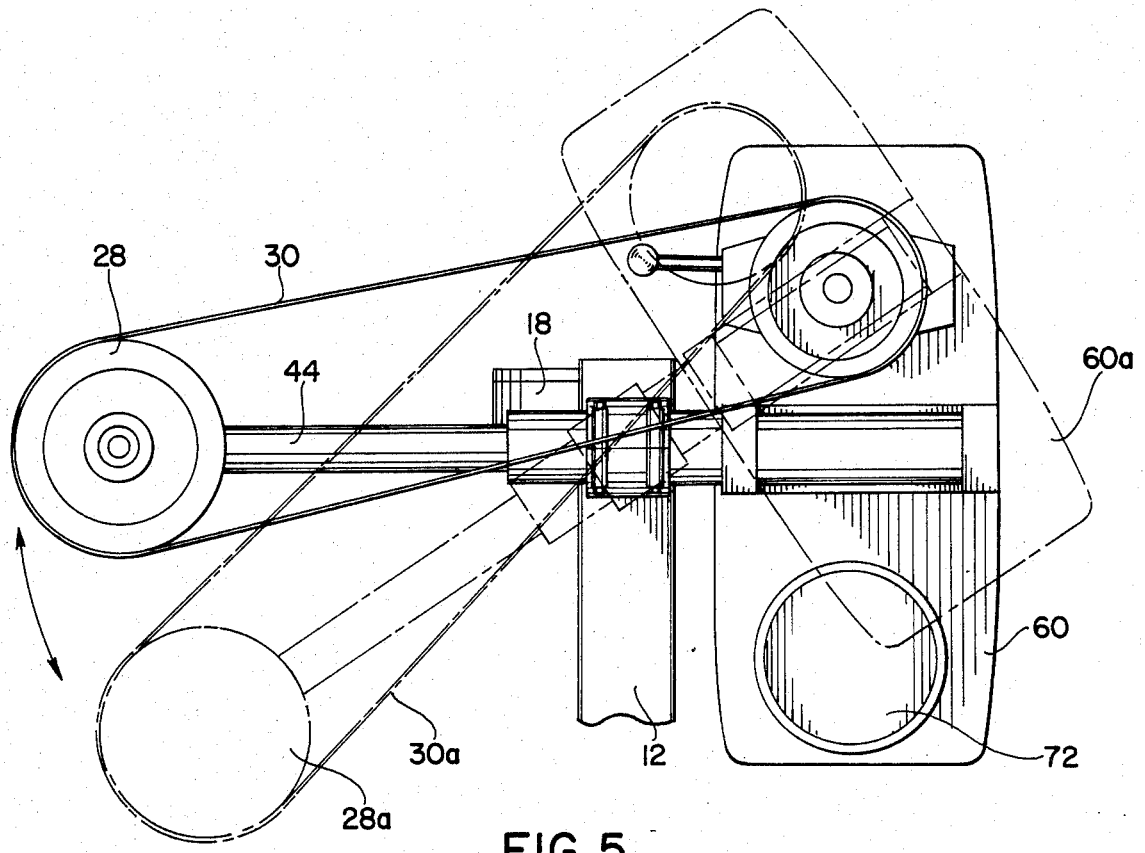
FIG. 5 is a rear elevational view similar to FIG. 2 but illustrating the manner in which the vertical position of the driven wheel may be varied with regard to a work station.
Figure 6:
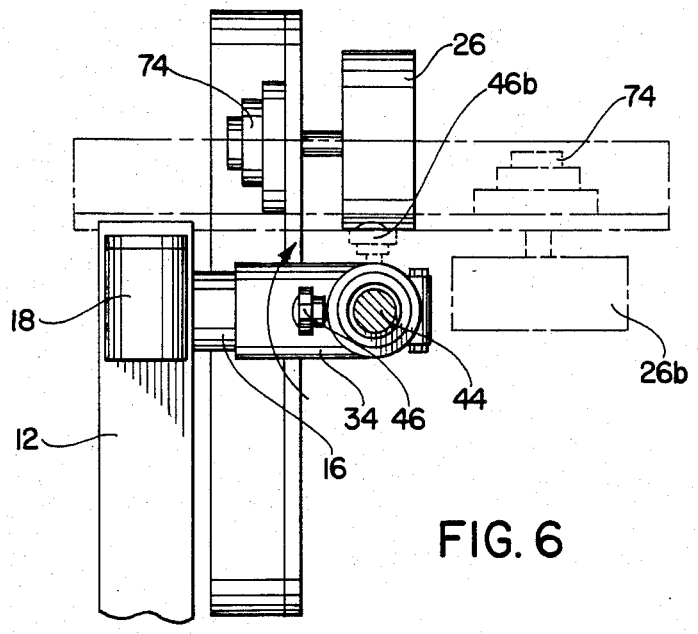
FIG. 6 is partial front sectional view taken along the lines 6—6 of FIG. 2.

A longitudinal frame 20 is adapted for fixed positioning in varying attitudes with respect to the post 12 by mounting means 22. The rear end of the fixed frame 20, that is, the right hand side as shown in FIG. 2, is adapted to support drive means 24 including a drive wheel 26 while the forward end of the frame 20 is adapted to position the driven wheel 28 with respect to a work station (not shown). An abrasive, polishing or otherwise finishing belt 30 is trained around the drive and driven wheels 26, 28 respectively. The driven wheel and subsequently the belt 30 may be positioned such that the belt passes at right angles to, that is, normally, to a piece being worked. Such position is shown in FIGS. 1, 2, and 3. Alternatively, the belt may be shifted such that is run is parallel, that is, in the same plane as the work station objects as shown in FIGS. 4 and 6. In both such positions, the vertical height at which the driven wheel and, accordingly, the belt is positined via the work station may be varied up or down as shown in FIG. 5. The manner in which said alternate positions may be achieved will be discussed more fully hereinafter.

Returning now the drawings and particularly FIG. 3 thereof, the structure of the longitudinal frame 20 and the means by which it is mounted to the post 12 is best shown. The frame 20 includes a tube 32 open at its forward end 34. The mounting means 22 include a hollow right-angled clamp having a base segment 34 adapted to extend over the stub shaft 16 and a hollow cylindrical outer segment 36 adapted to receive the tube 32. Both segments 34, 36 of the right-angled clamp are split or segmented and provided with aligned tubular ears 38 adapted to receive bolts 40. In this manner then tightening of the bolts 40 via nuts 42 draws the split segments 34 and 36 together so as to tightly respectively grasp the stub shaft 16 and the tube 32. By respectively releasing the pressure on the ears 38 by unloosening the nuts 42, the position of the right-angled clamp may be modified with respect to the frame via the stub shaft 16. This action is particularly shown in FIG. 5 wherein the vertical height of the driven wheel 28 may be repositioned as shown by the dotted line showing (28*a*) by partial rotation of the segment 34 with respect to the stub shaft 16 and thereafter retightening the same. Alternatively the shaft can outwardly extend from the frame or be a portion thereof. In such cases, the post would be provided with an opening for receipt of the shaft and means such as a set screw adapted to releasably clamp the shaft with respect to the post to provide the up and down settings of the driven head with respect to the work station. The releasable clamping means could also be provided in the frame when such alternate shaft configuration is not part of the frame. In either alternative, the base portion 34 of the clamp could be eliminated.

Similarly by untightening the bolts 40 of the segments 36, the main tube 32 may be rotated with respect to the right-angled clamp. Such action is shown in FIG. 6 of the drawings so as to arrive at an alternate position where the contact wheel 26 and the supported belt are parallel to the work at the work station (such is shown by dotted line position 26*b*). Tightening of the bolts 40 on the segments 36 fixes the frame 20 in this or other alternate positions shown in FIG. 4.

The open front end 34 of the main tube 32 receives a bar 44. Such bar 44 is longitudinally slidable within the main tube 32, and its position with respect thereto is fixed by a threaded locking post 46 threadably engaged with an opening (not shown) in the main tube and operable between locking and releasing positions by a handle 48. The outer end of the bar 44 positions a spindle block 50 thereon also held by a threaded locking post 52. The structure of the spindle post 50 which forms no part of the subject invention enables the contact wheel to be angularly canted with respect to the bar 44 so as to better align its position with the drive wheel 26 to assure minimum runout of the belt 30. The contact or driven wheel 28 is supported by the spindle block 50 via a shaft 54.

Thus it may be seen that by varying the position of the bar 44 with respect to the main tube 32, that various sizes of endless belts 30 may be accommodated by the device. Thus by loosening the lock post 46, the bar 44 may be inwardly and outwardly moved to shorten or lengthen the effective distance between the drive wheel and the driven wheel. Tightening such lock post 46 by means of the handle 48 also accomplishes a rough tensioning of the belt 30 between the wheels 26 and 28. Fine tensioning is accomplished by another aspect of the device which will hereinafter be more fully explained. It should also be brought out that the locking post 46 has been removed from FIGS. 1 and 4 for clarity.

At the rear of the main tube 32 a plate 56 having longitudinally spaced clamping ears 58 is fixedly clamped to the tube 32 and forms a part of the fixed frame 20. A swivel plate 60 is connected to the fixed plate 56 via a central bolt 62. As best shown in FIG. 2 of the drawings, the drive wheel 26 extends forwardly from the fixed plate 60 and is connected thereto by a bearing plate 64 via two longitudinally opposed bolts 66 and 67. Bolt 67 is received within a slot 68 in the bearing plate 64. Additionally the bearing plate 64 includes a forwardly disposed handle 70 such that the bearing plate and consequently the driving wheel 26 may be adjusted slightly up and down with respect to the swivel plate 60. It should be apparent that the entire drive means including the drive wheel 26, the motor 72, their associated pulleys 74 and 76, and the drive belt 80 are all mounted upon the swivel plate 60 and thus move as a unit with the various positions as previously indicated of the frame 20. In order to change speeds of the driving wheel, the drive belt 80 (V-belt) is engaged with various of the pulley groups 74, 76. The motor 72 is shaft connected tot he pulley 76 and the drive wheel to pulley 74, the latter through the bearing plate 64 which, as above indicated, can pivot slightly about bolt 66 via slot 67 when bolts 66 and 67 are loosened in order to facilitate V-belt pulley changes. Subsequently since the drive means is entirely self contained and movable with the frame, the need for complex and varied power drives and drive sources are eliminated. A flexible power line (not shown) extends between the power supply 18 and the motor 72.

Turning again to the drawings and particularly FIG. 2 thereof, a novel adjustment mechanism for slackening belt tension such that belts 30 can be easily removed and replaced is shown. Therein the lower half of the pivot plate 60 is provided with a L-shaped bracket 82. The base 84 of the bracket is fixedly connected to the plate 60 by known means such as a bolt and the outwardly extending shelf portion 86 thereof is adapted to threadably receive an adjustable stop member 88. The stop 88 in turn positions a compression spring 90 between it and one of the clamp ears 58. Since the clamp ear is fixed via its connection with the support 12, the normally compressed spring 90 will continually urge the plate 60 in a clockwise direction such that when it is otherwised unrestrained, the spring 90 will exert the proper tensioning upon the belt 30 in its fully extended position. This tension may be regulated by the threaded stop 88 with any given spring. It may be apparent that instead of using a fully extended spring position to control the extent of clockwise pivotal movement exerted on the plate 60, that a positive stop may be utilized. Also instead of spring means a fluid cylinder or any other means that forces the plate to rotate in the desired manner to accomplish the proper tensioning may be utilized. Incidentally when using a fluid cylinder as the urging force, it normally is not necessary to include the locking cam means 92 since slack in the belt is achieved when there is no fluid pressure.

On the other side of the center line, that is, to the left of the center as shown in FIG. 2, a cam mechanism 92 is pivotally mounted. Such cam mechanism includes a handle 94 and a cam 96 pivotally supported on a shaft 98. By moving a handle in a counterclockwise direction as shown by the arrow, the cam is forced upwardly thus rotating the plate 60 about its central connector 62 in a counterclockwise direction as shown by the upper arrow. This compresses the spring 90 and subsequently shifts the driving wheel 26 to the left as shown in FIG. 2*a* to achieve slack in the belt 30. In this position then as locked by the cam mechanism 90 and as represented by reference numerals 60*c* and 30*c* in FIG. 2*a*, the belt may be easily removed and another belt slipped in its place. When the cam mechanism is released, the action of the spring 90 or other means will force the plate to its position as shown in FIG. 2 and properly tension the belt 30. As previously explained in accommodating various sized belts, the bar 44 will be initially utilized to approximate the correct distance between the drive and driven wheels 26, 28.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A belt finisher having an endless abrasive belt trained over both a drive and driven wheel for grinding, polishing and otherwise finishing objects contacted by said belt comprising a longitudinally oriented fixed tubular frame, mounting means for mounting said driven wheel at the forward end of said frame, said means for mounting said driven wheel comprising a bar supported by said frame and longitudinally adjustably slidable with respect thereto, releasable clamp means for fixing the position of said bar with respect to said frame and to fix the distance between driven and drive wheel centers in said first position, mounting means for mounting drive means including said driving wheel at the rearward end of said frame, both said driven wheel and said drive wheel including the drive means therefor entirely supported and carried by said tubular frame, said drive means mounting means including an upstanding plate centrally attached to said fixed frame for limited rotational pivotal movement with respect thereto, said driving wheel mounted on said pivotal plate at one end thereof, including a driving motor for said drive wheel mounted at the other end of said pivotal plate, both said driving wheel and said motor outwardly disposed on one surface of said pivotal plate and variable pulleys for both said motor and said driving wheel mounted in spaced relation to each other on the opposite surface of said pivotal plate and a drive belt associated with said pulleys, means for continually pivotally urging said pivotal plate to a first position where the distance between said wheels operatively tensions said belt therebetween and means for overcoming said urging means so as to temporarily move said pivotal plate to a second position where said wheels are closer together and said belt assumes a relaxed attitude therebetween.

2. The belt finisher of claim 1, said frame including a centrally positioned hollow main tube having an open front end through which a rear portion of said bar is positioned therein and a rearwardly positioned upstanding plate fixed thereto, said drive means supported on said fixed support plate.

3. The belt finisher of claim 1, said drive wheel mounted on a bearing plate which in turn is connected to said pivotal plate, said bearing plate adapted to move with respect to said pivotal plate to a more central position in regard thereto such that said drive wheel pulley moves towards said motor pulley thereby releasing drive belt tension therebetween.

4. The belt finisher of claim 1, said pivot plate urging means adapted to urge said pivotal plate in a clockwise motion around said central attachment so as to force said driving wheel to said second position.

5. The belt finisher of claim 4, said pivot plate urging means disposed between said fixed support at a position rearward of said central attachment and a point on said pivotal plate therebelow.

6. The belt finisher of claim 4, said point on said pivotal plate defined by an outwardly extending bracket attached to said pivotal plate, said urging means being a compression spring operatively mounted therebetween and said means for overcoming said spring being a pivotal cam positioned on said pivotal plate below said fixed support and adapted to act upwardly thereon at a point forwardly of said central attachment.

* * * * *